United States Patent [19]

Pfeiffer et al.

[11] 4,422,308

[45] Dec. 27, 1983

[54] APPARATUS FOR SPREADING A MOVING WEB OF TEXTILE MATERIAL

[75] Inventors: Manfred Pfeiffer, Michelstadt-Steinbach; Manfred Schuierer, Michelstadt, both of Fed. Rep. of Germany

[73] Assignee: Bruckner Apparatebau GmbH, Erbach, Fed. Rep. of Germany

[21] Appl. No.: 273,230

[22] Filed: Jun. 12, 1981

[30] Foreign Application Priority Data

Jul. 3, 1980 [DE] Fed. Rep. of Germany ..... 3025154

[51] Int. Cl.[3] ..... D06B 23/00; B65H 25/26

[52] U.S. Cl. ..... 68/13 R; 26/20; 26/75; 68/20; 68/62; 68/177; 68/205 R; 226/15

[58] Field of Search ..... 8/151, 152; 68/13 R, 68/62, 177, 178, 205 R, 20; 226/3, 15; 26/75, 20, 21

[56] References Cited

U.S. PATENT DOCUMENTS

| | | | |
|---|---|---|---|
| 3,243,978 | 4/1966 | Gowin | 226/15 X |
| 3,271,102 | 9/1966 | Morgan | 68/177 X |
| 4,322,026 | 3/1982 | Young, Jr. | 226/15 |

FOREIGN PATENT DOCUMENTS

| | | | |
|---|---|---|---|
| 242936 | 12/1925 | United Kingdom | 68/177 |
| 1321474 | 6/1973 | United Kingdom | 226/15 |

*Primary Examiner*—Philip R. Coe

*Attorney, Agent, or Firm*—Learman & McCulloch

[57] ABSTRACT

The invention relates to a process and an apparatus for spreading a moving web of textile material during a treatment by means of fluid streams directed from the middle to the edges of the web. The side edges of the web are probed by sensors which control the fluid streams directed onto the associated edges of the web. In this way, reliable spreading is obtained with minimal outlay, even with different webs of textile material and under varying working conditions.

15 Claims, 11 Drawing Figures

APPARATUS FOR SPREADING A MOVING WEB OF TEXTILE MATERIAL

BACKGROUND OF THE INVENTION

This invention relates to a process for spreading a moving web of flat textile material during a treatment.

Web-form textile materials are frequently subjected to a wet treatment (for example dyeing or rinsing) in strand form. The disadvantage of this lies in the creases arising out of the strand-like form which spoil the appearance of the finished fabric.

Because of this, processes and apparatus have already been developed for the wet-treatment of a moving web of textile material in spread-open or expanded form. However, many web-form textiles, particularly elastic web-form textiles with little dimensional stability, have a tendency, when subjected to a wet treatment of the type in question in spread-open form, to form creases again or even to converge into a strand-like form. In order to counteract this tendency, it is known in the batch dyeing of carpets in dye vats that the web of fabric circulating endlessly in the vat can be guided over spreading rollers. However, processes and apparatus of this type involve considerable outlay for equipment and, in addition, are attended by the disadvantage of poor adaptability in operation.

Finally, in other known processes for spreading a moving web of textile material during a wet treatment (cf. German Auslegeschrifts Nos. 25 20 748 and 24 30 135), the web of textile material which is guided through a liquid bath by means of upper and lower continuously circulating, perforated conveyor belts is spread open by delivering to the upper and lower wide side of the web of fabric streams of liquid which are directed from the middle to the edges of the fabric web.

SUMMARY OF THE INVENTION

The object of the present invention is to develop apparatus for spreading a moving web of textile material by means of fluid streams directed towards the edges of the fabric web in such a way that reliable spreading of the fabric web is guaranteed by very simple means both in terms of construction and in terms of operation, even with different types of fabric webs and under varying working conditions.

According to the invention, this object is achieved in that the two side edges of the fabric web are probed by sensors which control the fluid streams directed onto the associated edges of the fabric web. That is, a shift in the edges of the web from a preselected position is sensed, following which the fluid streams are regulated to return the edges to the preselected position.

The edges of the fabric web are best probed by the sensors in the vicinity (in front of or behind) the point at which the fluid streams impinge on the fabric web for the purpose of spreading it.

The probing of the edges of the fabric web by means of sensors and the control of the fluid streams by those sensors provides for extremely sensitive and rapid adaptation of the spreading effect to the particular conditions prevailing and, in particular, to varying tendencies of the fabric web towards creasing, lateral shifting, etc.

The apparatus according to the invention is further distinguished by particularly low outlay, especially since the signal supplied by the sensors may be used to deliver fluid streams to the fabric web only insofar as a spreading effect is in fact required. However, it is of course also possible in accordance with the invention continuously to deliver a certain basic quantity of the fluid streams to the fabric web (for example a quantity of solution and/or air which is intended to be delivered to the fabric web at this point for processing reasons), whereas the signal supplied by the sensors is only used for controlling additional fluid streams which perform a spreading function.

DESCRIPTION OF THE DRAWINGS

Further details of the invention will become apparent from the appended claims, the following description, and the accompanying drawings, wherein:

Figure 1:
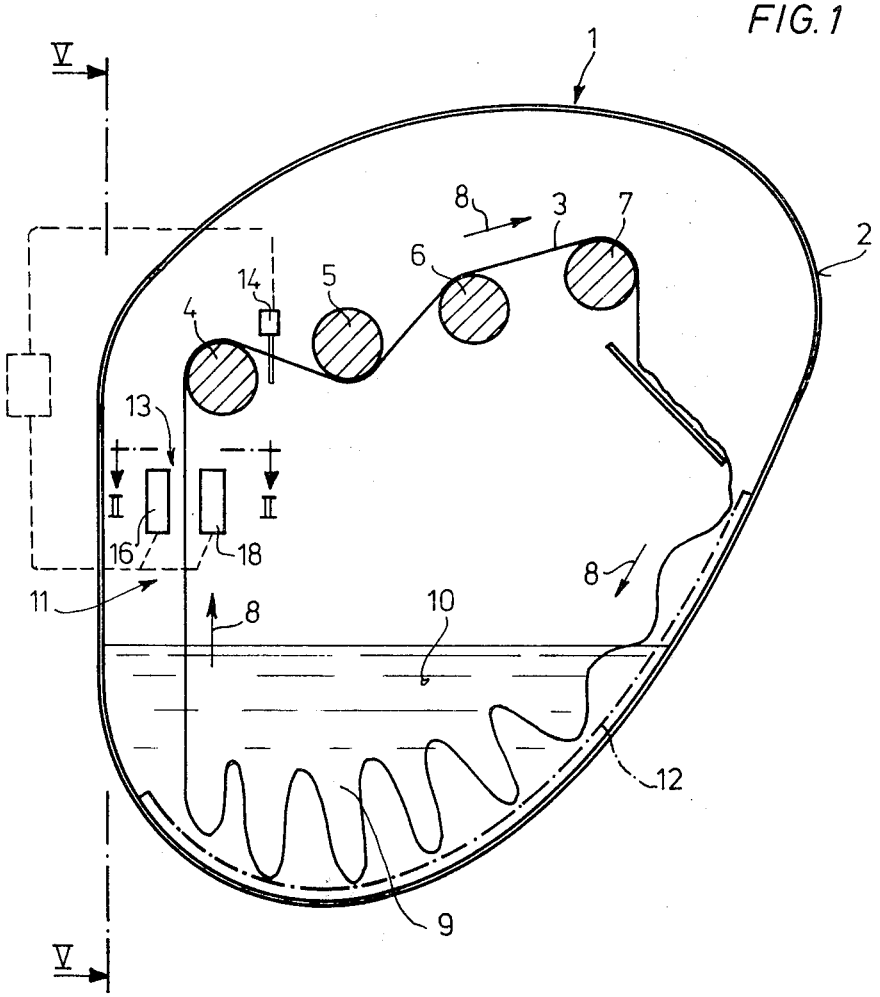
FIG. 1 is a vertical section through a first embodiment of the apparatus, particularly an associated wet-treatment vat.

So far as FIGS. 1 to 11 are concerned, it is pointed out from the outset that only those parts of the apparatus which are necessary for explaining the invention have been shown in the drawings whereas the other known parts of the apparatus which normally are necessary for web movement have been left out in the interests of clarity.

Of a wet-treatment apparatus, FIG. 1 shows the wet-treatment vat 1 of which the vat housing 2 may have the usual cross-sectional form (as illustrated). A web 3 of textile material circulates endlessly in this wet-treatment vat 1 in the direction of the arrows 8 by means of guide rollers and feed rollers 4, 5, 6 and 7. Of these rollers 4–7, at least one is driven in the usual way, whilst the others rotate freely as friction rollers. The rollers 4–7 are arranged in the upper part of the vat 1, preferably in a plane which slopes obliquely upwards in the direction of circulation (arrow 8). The actual treatment compartment 9 with a fabric storage chamber is situated in the lower part of the vat.

When the fabric web 3 is undergoing the wet treatment, this treatment compartment 9 contains a corresponding bath 10 of treatment liquid (depending on whether the web is being dyed, rinsed, bleached, washed, etc.). During the wet-treatment, the endlessly circulating fabric web 3 is repeatedly transported through the treatment bath 10, as is normally the case, and at the same time is stored in the treatment compartment 9 (as shown in FIG. 1). The particular fabric web stored in the treatment compartment 9 is then withdrawn upwards from the treatment bath 10 by means of the guide and feed rollers 4–7, initially following a vertical path 11 before arriving at the first turning point of change of direction, namely the first roller 4 (as seen in the direction of circulation indicated by the arrow 8). The fabric web 3 travels repeatedly around the guide and feed rollers 4, 5, 6 and 7 is further transported and, after passing the last, upper roller 7 (which could be in the form of a winch), is returned to the beginning of the treatment compartment 9. In the region of this web return path and also in the lower part, the inside of the vat housing 2 may be in the form of a smooth slide, making it possible to obtain a favourable delivery effect into the treatment bath 10. In addition, a polytetrafluoroethylene grid 12 which particularly promotes return of the fabric web 3 into the treatment compartment 10 could also be arranged in the above-mentioned region, as indicated in dash-dot lines.

To enable the web 3 of textile material to be treated in permanently expanded form, apparatus 13 for spreading the moving web 3 is arranged in the vat 1. To enable particularly effective spreading of the web 3 to be obtained, the spreading apparatus 13 is best arranged in a zone where the web undergoes minimal stretching in the longitudinal direction, for which purpose the zone in which the web 3 follows the vertical path 11, i.e., the substantially vertical zone between the web storage chamber (in the treatment compartment 9) and the first guide roller 4, has proved to be particularly favourable. In this connection, it is also best to position the spreading arrangement a relatively short distance in front or upstream of the first guide and feed roller, whereas web edge sensors 14 of known construction, (cf, also FIG. 5) are arranged either above or just behind or downstream this first roller 4. As already mentioned above and as will be explained in more detail hereinafter, these edge sensors 14 control the spreading apparatus 13.

Figure 2:
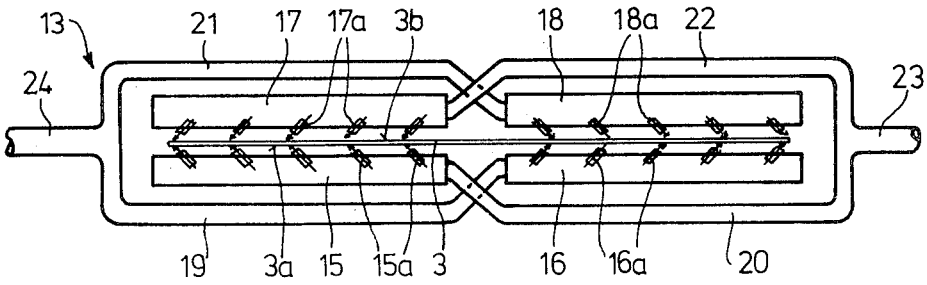
FIG. 2 is a cross-section through part of the vat substantially along the line II—II in FIG. 1 showing a first embodiment of nozzle units for spreading the fabric web.

As can be seen in particular from FIG. 2, the spreading apparatus 13 comprises—for each wide side 3*a* and 3*b* of the fabric web 2—two nozzle units capable of being supplied with fluid independently of one another, namely the nozzle units 15, 16 for the front wide side 3*a* of the web and the nozzle units 17, 18 for the rear wide side 3*b* of the web. In the embodiment illustrated in FIG. 2, the nozzle units 15–18 are in the form of nozzle boxes comprising a plurality of individual fluid projection nozzles 15*a*, 16*a*, 17*a*, 18*a*. Each nozzle box 15–18 is associated with one half of the fabric web 3 on the corresponding wide side thereof (i.e., with one half of the corresponding wide side of the web). Each nozzle box is separately supplied with a fluid stream through a feed pipe 19, 20, 21, 22, the nozzles 15*a*, 16*a*, 17*a*, 18*a* of the nozzle boxes 15–18 being designed and set up in such a way that the fluid streams introduced through the feed pipes 19–22 are each delivered to the fabric web 3 along a path which extends in a direction from the middle to the edges of the fabric web. In other words the fluid streams issuing from the nozzle boxes 15–18 are obliquely directed onto the fabric web from the middle thereof and also toward the side edges thereof.

As shown in FIGS. 1 and 2 and as already mentioned, two independent nozzle boxes 15, 16 and 17, 18 are associated both with the front and also with the rear wide sides 3*a* and 3*b* of the fabric web 3, the arrangement being such that the nozzle boxes of both wide sides associated with one half of the fabric web are situated exactly opposite one another in pairs in regard to their fluid projection directions whilst the opposite pairs of associated nozzle boxes (i.e., the nozzle boxes 15 and 17; 16 and 18) are designed to receive the same quantity and pressure of fluid, for which purpose the corresponding feed pipes are respectively connected to a common supply line. In FIG. 2, therefore, the feed pipes 20, 22 for the nozzle boxes 15, 17 are connected to a common supply line 23 whilst the feed pipes 19, 21 for the nozzle boxes 16, 18 are connected to a supply line 24, these supply lines being connected to a source of pressure fluid (not shown) and containing valves (not shown) that are opened and closed in response to operation of the sensors 14. FIG. 1 shows schematically, in dash lines, an electrical control system of known kind for effecting operation of the valves.

However, it is pointed out at this juncture that the nozzle units may also be arranged on only one of the wide sides of the fabric web, in which case at least one flat supporting surface is arranged exactly opposite the nozzle units on the other wide side. In this way, the fabric web 3 is always reliably supported in the region in which the fluid streams impinge on it to keep it spread open both in the embodiment described with reference to FIG. 2 and also in the embodiment which has just been described.

Figure 3:
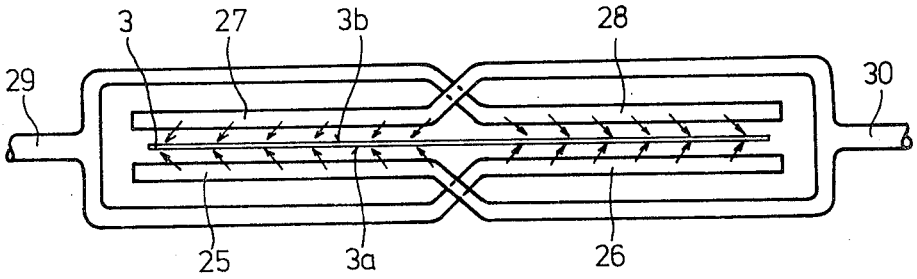
FIG. 3 is a section similar to FIG. 2 showing a second embodiment of the nozzle units.

Another possible embodiment for the nozzle units is shown in FIG. 3. In this embodiment, each nozzle unit may be formed by a nozzle pipe 25, 26 (for the front wide side 3*a* of the fabric web) and 27, 28 (for the rear wide side 3*b* of the fabric web) provided with a plurality of nozzle orifices for projection of the fluid. In this case, too, the nozzle orifices of the nozzle pipes 25–28 may be oriented in the required outlet direction for the stream of fluid or may even contain separate fluid nozzles which in that case are oriented in the necessary outlet direction for the stream of fluid, as already described with reference to FIG. 2. In the same way as in the embodiment shown in FIG. 2, the nozzle pipes 25–28 are arranged in pairs on opposite wide sides of the fabric web and are correspondingly connected to fluid supply pipes 29 (for the nozzle pipes 26, 28) and 30 (for the nozzle pipes 25 and 27), this arrangement and connection of the nozzle pipes 25–28 to the associated supply pipes 29, 30 being particularly simple to make and install.

Figure 4:
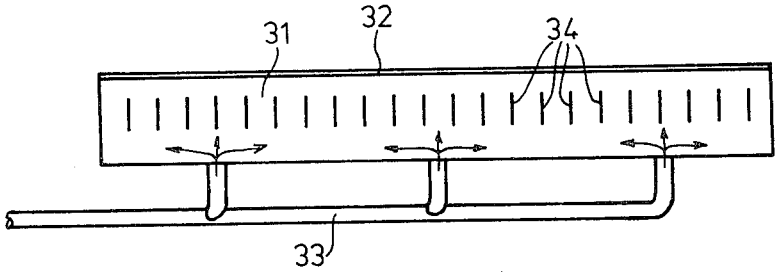
FIG. 4 is a side elevation of a nozzle box of another variant.

FIG. 4 shows another variant of a nozzle unit in the form of a nozzle box 31. This nozzle box 31 has at least one outflow slot 32 for a fluid. As already described with reference to FIG. 2, a feed pipe 33 is connected to the nozzle box 31, distributing the fluid to be supplied over the length of the nozzle box 31 through several branch pipes. To enable an inflowing stream of fluid to be oriented in the required manner (from the middle to the edges of the fabric web) with this slot type nozzle box, too, a plurality of guide elements is correspondingly arranged in the nozzle box 31. These guide elements may be formed by simple baffle plates, shutters or the like and may be installed either fixedly or (as is generally preferred) for adjustment either individually or together.

The projection nozzles in the embodiments shown in FIGS. 2 and 3 may also be either fixedly directed or may be designed for adjustment in size and/or direction.

Irrespective of the embodiment adopted for the nozzle units, it is important to ensure that a minimum height is available for the fluid streams to act on the fabric web 3 in the vicinity of the vertical path 11. In this respect, it has proved to be favourable for this height, i.e., the length of that section of the path followed by the fabric along which the fluid streams impinge on it, to be kept to at least about half the width of the fabric web, although a height of from about 40 to 100 cm should be maintained according to the nature of the fabric web to be treated.

As already mentioned further above and as will be explained in the following with reference to FIG. 5, both gases, preferably air, and also liquids, preferably treatment solution, may be used as the fluid for forming the fluid streams used for spreading.

If the fabric web 3 is to be kept spread open by means of air streams delivered to it through the nozzle units described above, it has proved to be of particular advantage for the nozzle units (for example 15–18 in FIG. 2) of each half of the fabric web to receive an air stream taken from the upper part of the vat 1, for which purpose a fan 35, 36 is arranged on the vat housing 2 in the vicinity of each end 2*a*, 2*b* of the vat, by means of which air is extracted from the corresponding part of the vat and projected through the nozzle units onto the fabric web 3 under a pressure of preferably around 0.2 bar (during the normal spreading function) in such a way that the fabric web is spread apart in the manner already described. In this connection, it can also be of particular advantage for the air extracted by means of the fans 35, 36 to be delivered to that half of the fabric web which is situated opposite the fan and the corresponding end 2*a*, 2*b* of the vat, as can clearly be seen from the pipe arrangement in FIG. 5, so that as it were a kind of cross-flow with a regularising treatment effect is obtained. In addition, fluid control valves 37, 38 and 37*a*, 38*a* are best respectively arranged in the supply pipes 23 and 24 leading from the fans 35, 36 to the nozzle units 25 to 17, enabling the fluid streams to be manually and/or automatically controlled.

Figure 5:
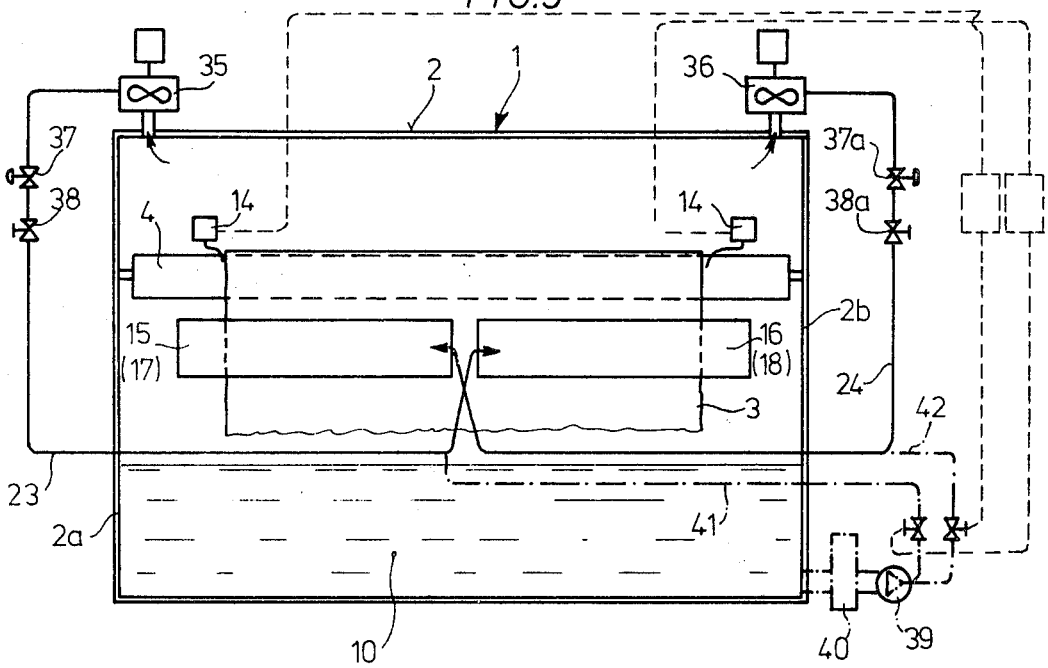
FIG. 5 is a cross-section through the wet-treatment vat on the line V—V in FIG. 1 showing the path followed by the individual fluid streams.

As further illustrated in dash-dot lines in FIG. 5, the above-described supply of air from the upper part of the vat 1 to the nozzle units 15–18 may be replaced by or even combined with a supply of treatment liquid to the nozzle units 15–18 of each half of the fabric web from the treatment bath 10 in the lower part of the vat 1. In this case, the treatment liquid is pumped off from the solution bath 10 by means of a solution pump 39—preferably with a filter 40 in between (a fluff filter which is generally necessary in any case may be used for this purpose)—and delivered to the nozzle units 15–18 through the dash-dot supply pipes 41,42 in the same way (again controlled by valves) as in the supply of air. A liquid pressure of up to about 0.5 bar is generally sufficient for keeping the fabric web spread open, this pressure again depending of course upon the type of fabric web to be treated.

FIG. 5 also clearly shows the use of the edge sensors 14 for the fabric web 3. Since, in this embodiment, the nozzle boxes 15, 17 and 16, 18 facing one another on both wide sides of the fabric web are combined in pairs in regard to their spreading function and in effect form two independently feedable nozzle systems, each of these nozzle systems is connected in a known manner indicated in dash lines for control purposes to the edge sensor 14 of the corresponding half or edge of the fabric web. If then, for example, during the wet treatment of the fabric web 3 in the vat 1, the right-hand (in FIG. 5) edge sensor 14 is no longer in contact with the right-hand edge of the fabric web, the associated nozzle system (i.e., the pair of nozzle boxes 16, 18) is charged with fluid from the interior of the vat 1 so that the right-hand half of the fabric web is again completely spread out and stretched flat in the required manner. After this state has been reached (through corresponding probing by the associated edge sensor 14), the supply of fluid to this nozzle system may be correspondingly reduced or stopped altogether. In either case, the fact that the spreading apparatus 13 and edge sensors 14 are situated at a short distance from one another in the vicinity of the first guide roller 4 ensures that the fabric web 3 is subjected to action rapidly, i.e., without any significant delay, if it is to be transported in a state in which it is no longer completely spread open.

The spreading apparatus as described in particular with reference to FIGS. 2 to 4 does not necessarily have to be arranged in a wet treatment vat of the type illustrated in FIG. 1.

Figure 6:
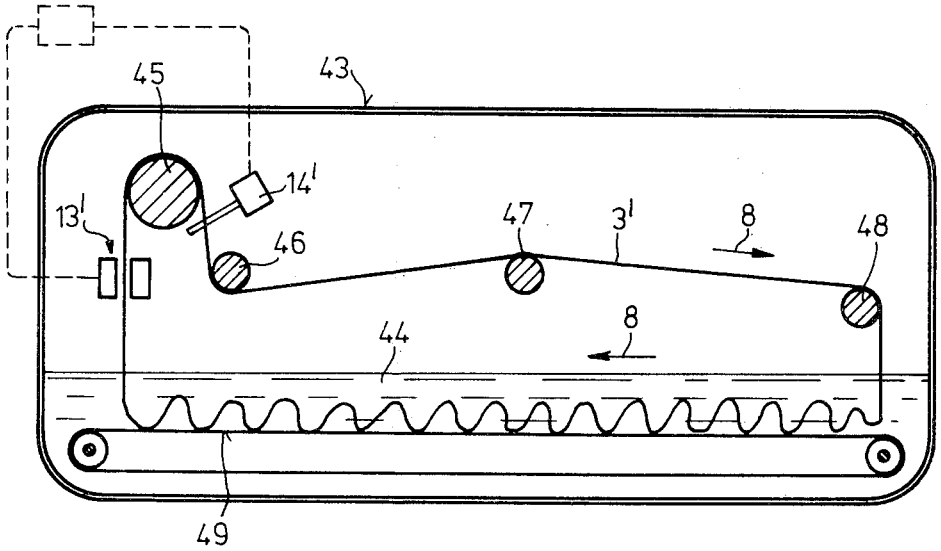
FIG. 6 is a vertical section through a vat modified in relation to that illustrated in FIG. 1.

FIG. 6 shows a flat, elongate embodiment of a wet treatment vat of which the lower part again accommodates the actual treatment compartment 44 (optionally filled with a treatment liquid) in which the continuously circulating fabric web 3' is also briefly stored. In this case, not only is the fabric web 3' (which again circulates in the direction of the arrows 8) transported by guide and feed rollers 45 to 48 in the upper part of the vat 43, a feed unit in the form of a conveyor belt or sieve belt 49 is also provided in the lower part of the vat 43, i.e., in the treatment compartment 44, ensuring that the circulating fabric web 3' is reliably transported from one end of the treatment compartment 44 to the other. In other respects, the spreading arrangement 13' and the web edge sensor 14' may be designed and arranged in the same way as described with reference to FIGS. 1 to 5.

A wet treatment vat may also be constructed in such a way that only one guide and feed unit (preferably in the form of a winch) need be arranged in its upper part.

Whereas the treatment and spreading of only one fabric web in a vat has been described in the previous embodiments, it is also possible simultaneously to treat several fabric webs in a single web treatment vat (or even in any other suitable container). In such a case, fluid spreading apparatus corresponding to one of the embodiments described earlier is separately used for each fabric web, in which case each of these arrangements may of course be supplied with fluid independently of one another.

Figure 7:
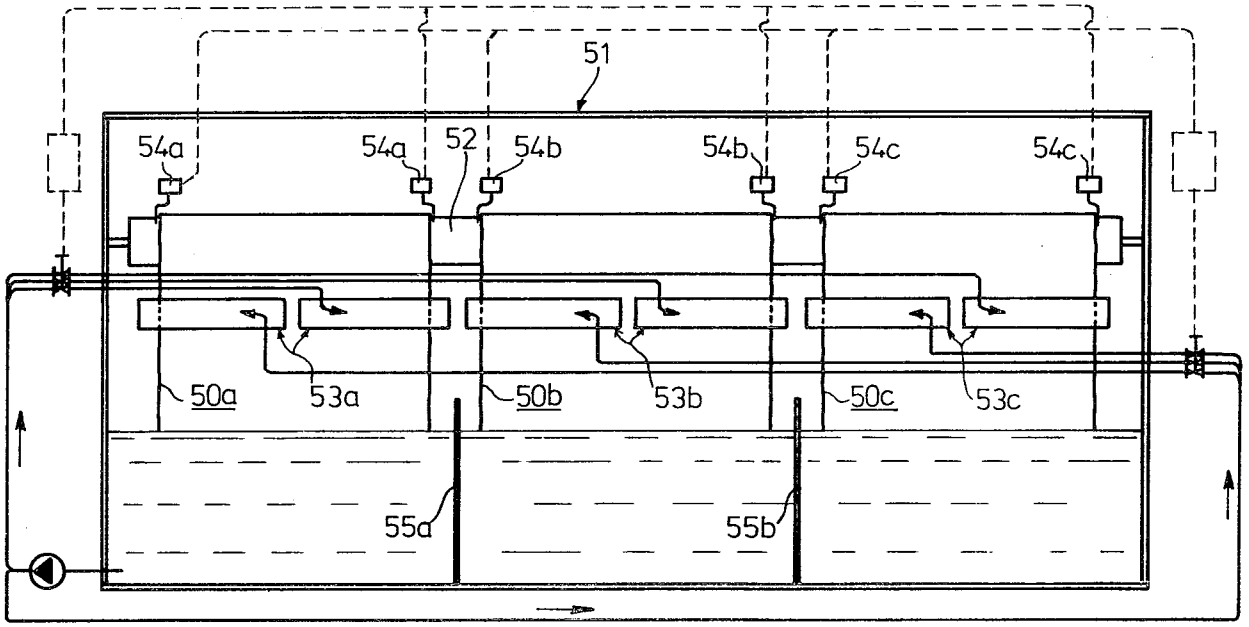
FIG. 7 is a cross-section similar to FIG. 5 showing another variant for simultaneously treating several fabric webs alongside one another in a single vat.

FIG. 7 shows an embodiment for simultaneously treating several fabric webs 50*a*, 50*b*, 50*c* in the same wet treatment vat 51 in which the vat itself may be largely constructed in the same way as the vat 1 shown in FIG. 1. Circulating endlessly around the guide and feed rollers 52 arranged in the upper part of the vat, the fabric webs 50*a*, 50*b*, 50*c* are non-continuously treated at intervals adjacent one another in the manner illustrated in FIG. 7. Accordingly, the separate spreading arrangements 53*a*, 53*b*, 53*c* with their nozzle units associated with each fabric web 50*a*, 50*b*, 50*c* and the associated web edge sensors 54*a*, 54*b* and 54*c* are arranged in groups adjacent one another in the form illustrated. The construction, arrangement and function of the fluid spreading arrangements and edge sensors may be the same as in FIGS. 1 to 5. For this reason, the supply of treatment liquid pumped off from the lower part of the vat to the individual nozzle units and the electrical control system have also been shown only very diagrammatically in FIG. 7.

In order to ensure, particularly in the embodiment of FIG. 7, that the fabric webs to be treated do not float sideways (which could have a particularly adverse effect upon the spreading), it is preferred to arrange between adjacent fabric webs (for example 50*a* and 50*b*; 50*b* and 50*c*) partitions 55*a*, 55*b* which may also be adjusted according to the width of the fabric webs to be treated.

Figure 8:
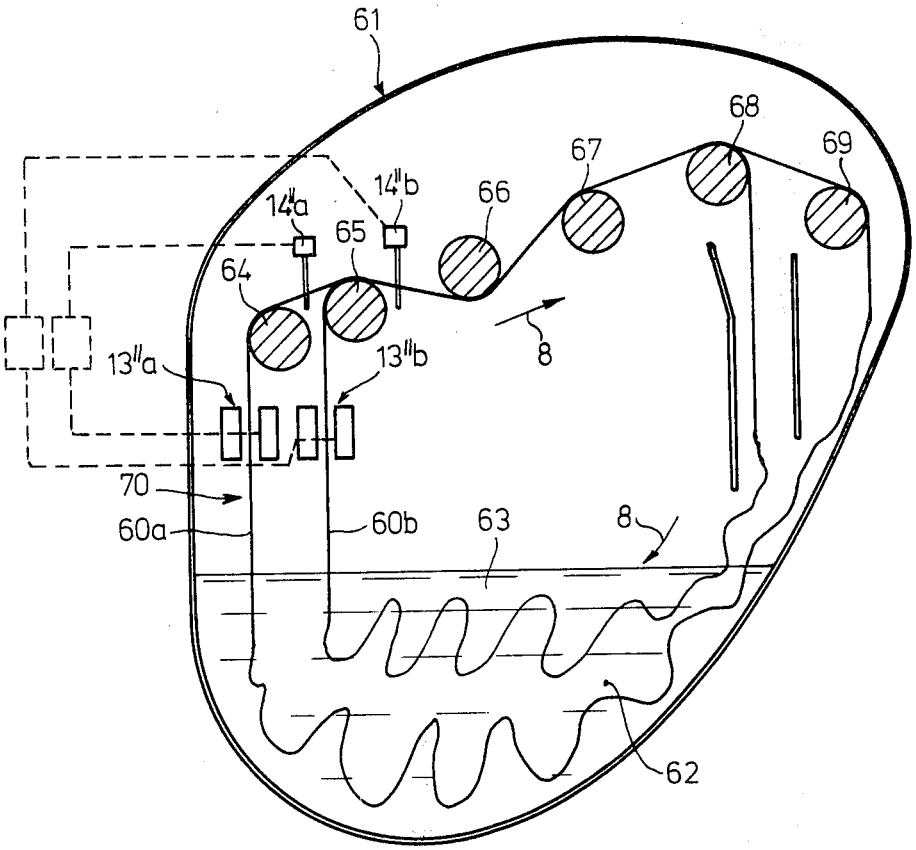
FIG. 8 is a vertical section similar to FIG. 1 showing an embodiment in which several fabric webs can be treated simultaneously one above the other.

It also is possible to treat simultaneously several fabric webs as is shown in FIG. 8. In this embodiment fabric webs 60*a*, 60 *b* to be treated are guided one above another or in several layers relative to one another over at least part of their endless circuit. The lower part of the wet treatment vat 61, which externally resembles the vat shown in FIG. 1, again accommodates the actual treatment compartment 62 with the web storage space and a treatment bath 63, whilst the upper part of the vat 61 again accommodates a plurality of guide and feed rollers 64–69 for transporting the fabric webs 60*a*, 60*b* in the direction of the arrows 8. Whereas the fabric webs 60*a*, 60*b* transported through the upper part of the vat lie one atop the other and traverse most of the guide and feed rollers 65–68, they travel largely separate from one another (cf. right-hand side of FIG. 8) back into the lower part of the vat, i.e., into the actual treatment compartment 62, where they are treated and stored largely separate from one another, but arranged one above the other in the treatment bath 63, before they are transported upwards along a substantially vertical path 70 on the one hand to the roller 64 and on the other hand to the roller 65. In this way, the two fabric webs 60*a*, 60*b* are kept at a sufficient distance apart from one another in the region of the above-mentioned path 70, so that fluid spreading apparatus 13″*a*, 13″*b* may be arranged in front of the first guide roller in the manner explained earlier. In this case, too, sensors 14″*a* and 14″*b* for the edges of the fabric web are again arranged for the first change of direction (roller 64) of the fabric web 60*a* and, on the other hand, for the first change of direction (roller 65) of the fabric web 60*a* to enable the fluid streams of the spreading arrangements 13″*a* and 13″*b* to be correspondingly controlled.

The embodiment which has just been described affords the advantage that several (more than two) fabric webs may be simultaneously treated in a comparatively narrow space, i.e., without having to use a particularly wide vat.

Figure 9:
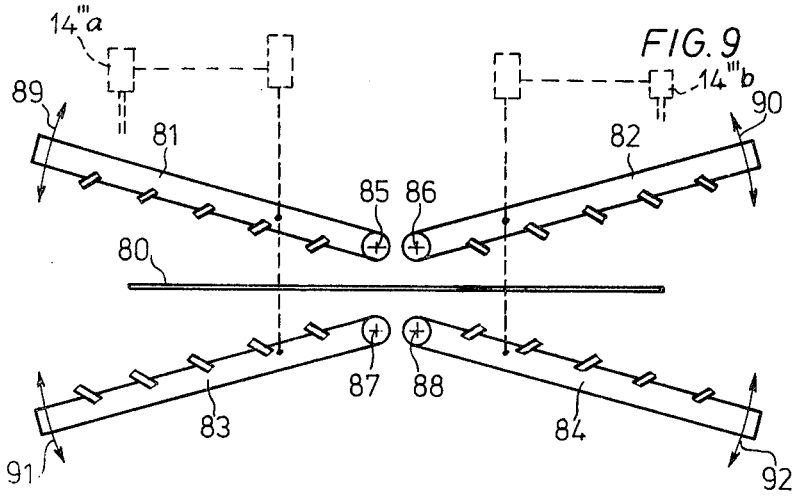
FIGS. 9 and 10 diagrammatically illustrate an embodiment comprising pivotal nozzle units.
Figure 10:
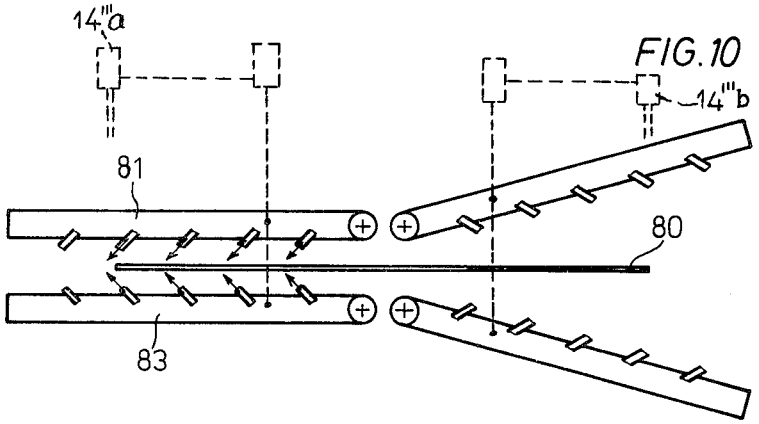

FIGS. 9 and 10 diagrammatically illustrate an embodiment in which two nozzles units 81, 82 and 83, 84 are arranged on either side of a fabric web 80. These nozzle units are pivotal in the direction of the double arrows 89–92 by known motor drives about pivot pins 85–88 arranged in the region of the middle of the fabric web. In this way, the distance separating the nozzles from the fabric web (the length of the fluid streams) and the spreading effect exerted on the fabric web by the fluid streams are adjustable.

If for example the fabric web 80 moves to the right, as in FIG. 10, the nozzle units 81 and 83 are pivoted towards one another, under the control of the sensors 14‴*a*, 14‴*b* which probe the two side edges of the fabric web, so that their nozzles move closer to the fabric web 80. The sensors 14‴*a* and 14‴*b* also control the flow of fluid through the nozzle units as before. In this way, the effect of the fluid streams directed to the left (in FIG. 10) is intensified and the fabric web 80 returned to its central position.

Instead of the pivotal mounting of the nozzle units characterising the embodiment illustrated in FIGS. 9 and 10, it is of course also possible to change the distance separating the nozzles from the fabric web by displacing the nozzle units along a straight line (either perpendicularly or obliquely of the fabric web).

Figure 11:
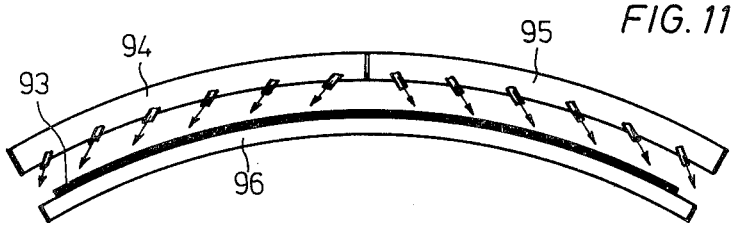
FIG. 11 diagrammatically illustrates an embodiment incorporating a convex support.

Finally, FIG. 11 diagrammatically illustrates an embodiment in which two nozzle units 94, 95 are provided on one only of the wide sides of the fabric web 93, delivering to the fabric web fluid streams directed onto the two edges of the fabric web. Provided on the other wide side of the fabric web 93 is a convex support 96 over which the fabric web travels.

What is claimed is:

1. In apparatus for treating a flat web of textile material having opposite edges, means for moving said web from a treatment and storage zone upwardly through a spreading station, and means downstream from said station for turning said web transversely to follow a path back to said zone, the improvement comprising sensing means for sensing movement of either one of said edges of said web from a preselected position toward the other of said edges; means mounting said sensing means downstream from said turning means; web shifting means mounted at said spreading station, said shifting means comprising a first nozzle unit overlying a part of said web and a second nozzle unit independent of said first nozzle unit and overlying the remainder of said web, one of said nozzle units having fluid passages for directing a stream of fluid obliquely onto said web in a direction toward one edge thereof and the other of said nozzle units having fluid passages for directing a stream of fluid obliquely onto said web in a direction toward the other edge thereof; means for delivering fluid to a selected one or both of said nozzle units for discharge through the respective fluid passages; and control means responsive to the sensing of movement of either one or both of said edges from said position toward the other to operate said delivering means to deliver fluid to the nozzle unit associated with said one or both of said edges, whereby said one or both of said edges may be returned to its or their preselected position or positions.

2. Apparatus according to claim 1 wherein each of said nozzle units comprises dual sets of passages located on opposite sides of said web.

3. Apparatus according to claim 1 wherein said fluid streams are gaseous.

4. Apparatus according to claim 1 wherein said fluid streams are liquid.

5. Apparatus according to claim 1 wherein said fluid streams are gaseous and liquid.

6. Apparatus according to claim 1 including a plurality of said webs and a corresponding plurality of said web moving means, said turning means, said nozzle units, said sensing means, and said control means.

7. Apparatus according to claim 6 including partition means interposed between adjacent ones of said webs.

8. Apparatus according to claim 6 wherein the sensing means and the control means associated with each of said webs are independently operable.

9. Apparatus according to claim 1 including means for varying the distance between said nozzle units and said web.

10. Apparatus according to claim 9 wherein said distance varying means comprises means pivotally mounting each of said nozzle units for swinging movements about an axis.

11. Apparatus according to claim 1 including a support for said web at said station, said support being convex from side to side in a direction toward said nozzle units.

12. Apparatus according to claim 1 including a housing containing said treatment and storage zone, and wherein said fluid delivering means comprises fan means for circulating air from within said housing through said nozzle units.

13. Apparatus according to claim 12 including valve means for controlling the flow of air delivered to said nozzle units.

14. Apparatus according to claim 1 wherein said fluid delivering means comprises means for pumping fluid from said zone through said nozzle units.

15. Apparatus according to claim 14 including valve means for controlling the flow of fluid delivered to said nozzle units.

* * * * *

UNITED STATES PATENT AND TRADEMARK OFFICE

CERTIFICATE OF CORRECTION

PATENT NO. : 4,422,308

DATED : December 27, 1983

INVENTOR(S) : Manfred Pfeiffer, et al

It is certified that error appears in the above-identified patent and that said Letters Patent are hereby corrected as shown below:

Column 1, line 6, change "a process" to -- an apparatus --.

Column 7, line 43, change "60a" to -- 60b --; line 52, change "nozzles" to -- nozzle --.

Signed and Sealed this

Tenth Day of April 1984

[SEAL]

Attest:

GERALD J. MOSSINGHOFF

Attesting Officer

Commissioner of Patents and Trademarks